US005665036A

United States Patent [19]

Hsieh

[11] Patent Number: 5,665,036

[45] Date of Patent: Sep. 9, 1997

[54] EXERCISE APPARATUS FOR BENCH PRESS AND BUTTERFLY EXERCISES

[75] Inventor: Yi Fong Hsieh, Succasunna, N.J.

[73] Assignee: LifeGear, Inc., Rockaway Township, N.J.

[21] Appl. No.: 680,019

[22] Filed: Jul. 15, 1996

[51] Int. Cl.[6] ..... A63B 23/12; A63B 21/06

[52] U.S. Cl. ..... 482/100; 482/138

[58] Field of Search ..... 482/94, 97–100, 482/133, 135, 136, 137, 138

[56] References Cited

U.S. PATENT DOCUMENTS

| | | | |
|---|---|---|---|
| 4,840,373 | 6/1989 | Maag | 482/136 X |
| 5,290,214 | 3/1994 | Chen | 482/137 |
| 5,518,482 | 5/1996 | Hsieh | 482/138 X |

FOREIGN PATENT DOCUMENTS

| | | | |
|---|---|---|---|
| 263000 | 12/1988 | Germany | 482/136 |
| 94/02213 | 2/1994 | WIPO | 482/100 |

*Primary Examiner*—Richard J. Apley
*Assistant Examiner*—John Muleahy
*Attorney, Agent, or Firm*—David L. Davis

[57] ABSTRACT

Exercise apparatus which enables the user to selectively perform a bench press exercise or a butterfly exercise using the same apparatus elements without requiring any modification to the apparatus by the user. A pair of exercise arms are mounted to a pivot bar for pivoting movement each about a respective one of a pair of parallel pivot axes and are interconnected for concurrent pivoting movement in opposite angular directions about the pair of pivot axes by respective intermeshed circular gear segments. The pivot bar is mounted to an overhead member for pivoting movement about a horizontal pivot axis. When a butterfly exercise is being performed, the apparatus provides equal resistance to both of the user's arms and insures that both arms move at the same speed. When a bench press exercise is being performed, the meshing of the circular gear segments locks the exercise arms together.

7 Claims, 4 Drawing Sheets

EXERCISE APPARATUS FOR BENCH PRESS AND BUTTERFLY EXERCISES

BACKGROUND OF THE INVENTION

This invention relates to exercise apparatus and, more particularly, to exercise apparatus which enables the user to selectively perform a bench press exercise or a butterfly exercise using the same apparatus elements without requiring any modification to the apparatus by the user.

Exercise apparatus is known, in general, which enables a user to selectively perform a bench press exercise or a butterfly exercise using the same elements of the apparatus. However, since the motions are different for the two exercises, all such known apparatus requires the user to modify the apparatus, either by locking or unlocking the elements, when switching between the two exercises. Accordingly, there exists a need for exercise apparatus which does not require any user modification in order to be switched between the two exercises.

Further, when the user is performing a butterfly exercise, it would be desirable to provide equal resistance to both of the user's arms and to insure equalization of the speed of both arms.

SUMMARY OF THE INVENTION

The present invention provides exercise apparatus which enables a user to selectively perform a bench press exercise or a butterfly exercise without making any modifications to the apparatus. The apparatus comprises a support frame with a base and an overhead member, a weight stack arranged for vertical reciprocatory movement relative to the base, a pair of exercise arms each of which is generally L-shaped and each having a hand grip at one end, and a pivot bar having a first end, a second end and a longitudinal axis extending from the first end to the second end. The exercise arms are mounted at their ends opposite their hand grip ends to the pivot bar first end for pivoting movement each about a respective one of a pair of parallel pivot axes. The mounting means is effective to orient the exercise arms each with its hand grip end below the opposite end and each in a respective plane substantially coplanar with the respective pivot axis. The pair of exercise arms are interconnected for concurrent movement in opposite angular directions about the pair of pivot axes and the pivot bar is mounted at its second end to the overhead member for pivoting movement about a horizontal pivot axis orthogonal to the pivot bar longitudinal axis. The pair of exercise arms are coupled to the weight stack to provide resistance both to pivoting movement of the exercise arms each in a respective first angular direction about the respective one of the pair of pivot axes and to pivoting movement of the pivot bar in a respective first angular direction about the horizontal pivot axis.

In accordance with an aspect of this invention, the interconnection of the pair of exercise arms is effected through a pair of intermeshed circular gear segments each of which is secured to a respective exercise arm with its center of rotation being aligned with a respective one of the pair of parallel pivot axes.

BRIEF DESCRIPTION OF THE DRAWINGS

The foregoing will be more readily apparent upon reading the following description in conjunction with the drawings in which like elements in different figures thereof are identified by the same reference numeral and wherein.

DETAILED DESCRIPTION

Figure 1:
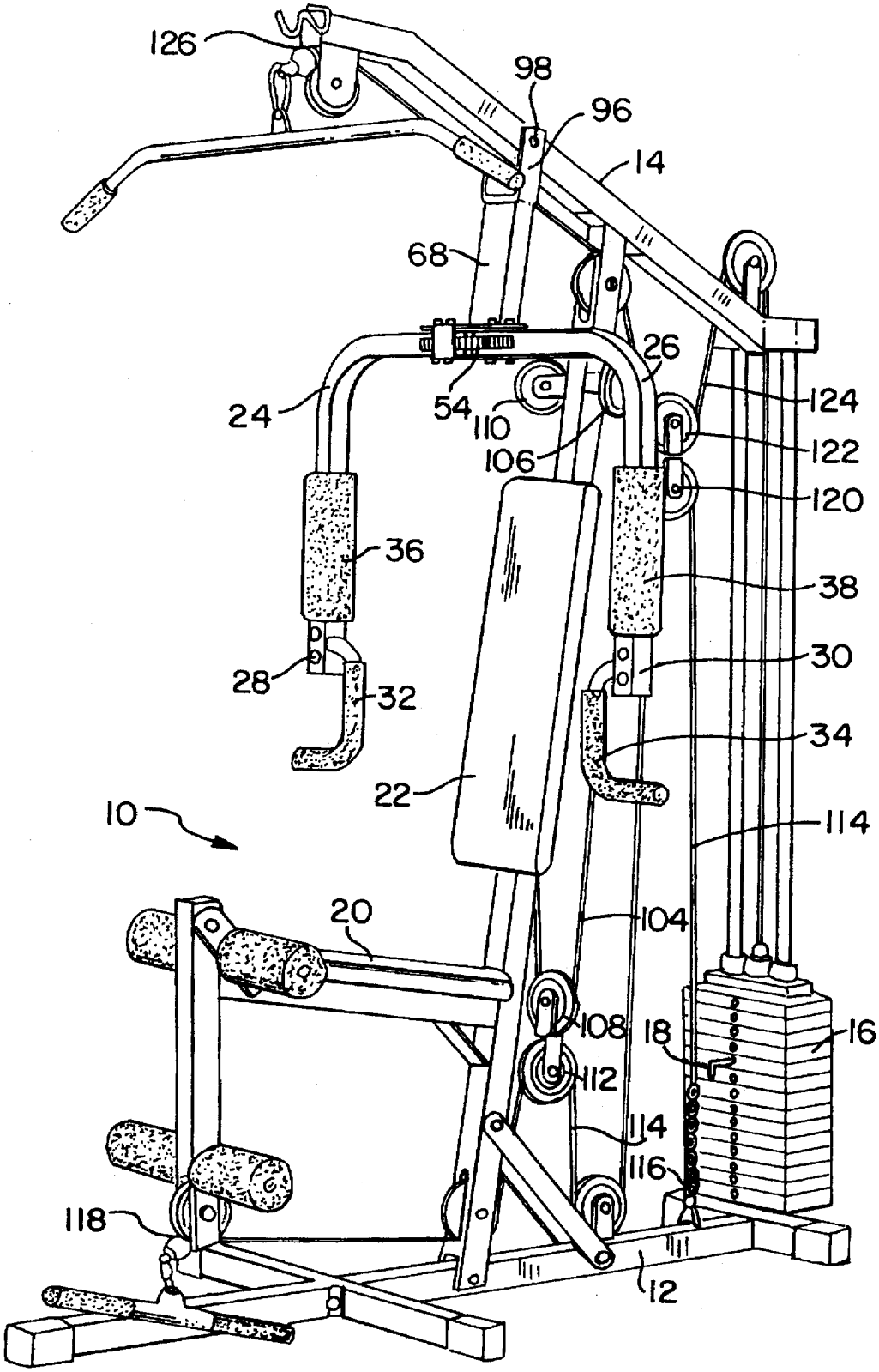
FIG. 1 is a perspective view of exercise apparatus constructed in accordance with the principles of this invention.

Referring now to the drawings, shown therein is exercise apparatus, designated generally by the reference numeral 10, which, among its other functions, enables a user to switch between performing a bench press exercise and performing a butterfly exercise without making any modification to the apparatus 10. As shown, the apparatus 10 includes a generally skeletal support frame having a base 12 and an overhead member 14. A weight stack 16 is provided and is arranged for vertical reciprocatory movement relative to the base 12. As is well known, a pin 18 is insertable at a desired location along the weight stack 16 to enable the user to vary the resistance provided by the stack 16. The apparatus 10 further includes a seat 20 and a back rest 22 for supporting the user, as is known. The apparatus 10 is of a type generally known in the art and only those portions directly related to the inventive improvement will be discussed in detail herein.

To perform the bench press and butterfly exercises, a pair of exercise arms 24, 26 are provided. Each of the exercise arms 24, 26 is formed of hollow rectangular tubing and is bent into an L-shape. At each respective end 28, 30 of the exercise arms 24, 26, there is provided a respective hand grip 32, 34. Each hand grip 32, 34 is preferably provided with an outer foam cushion. Likewise, outer foam cushions 36, 38 are preferably provided on the exercise arms 24, 26, near their ends 28, 30, respectively.

Figure 2:
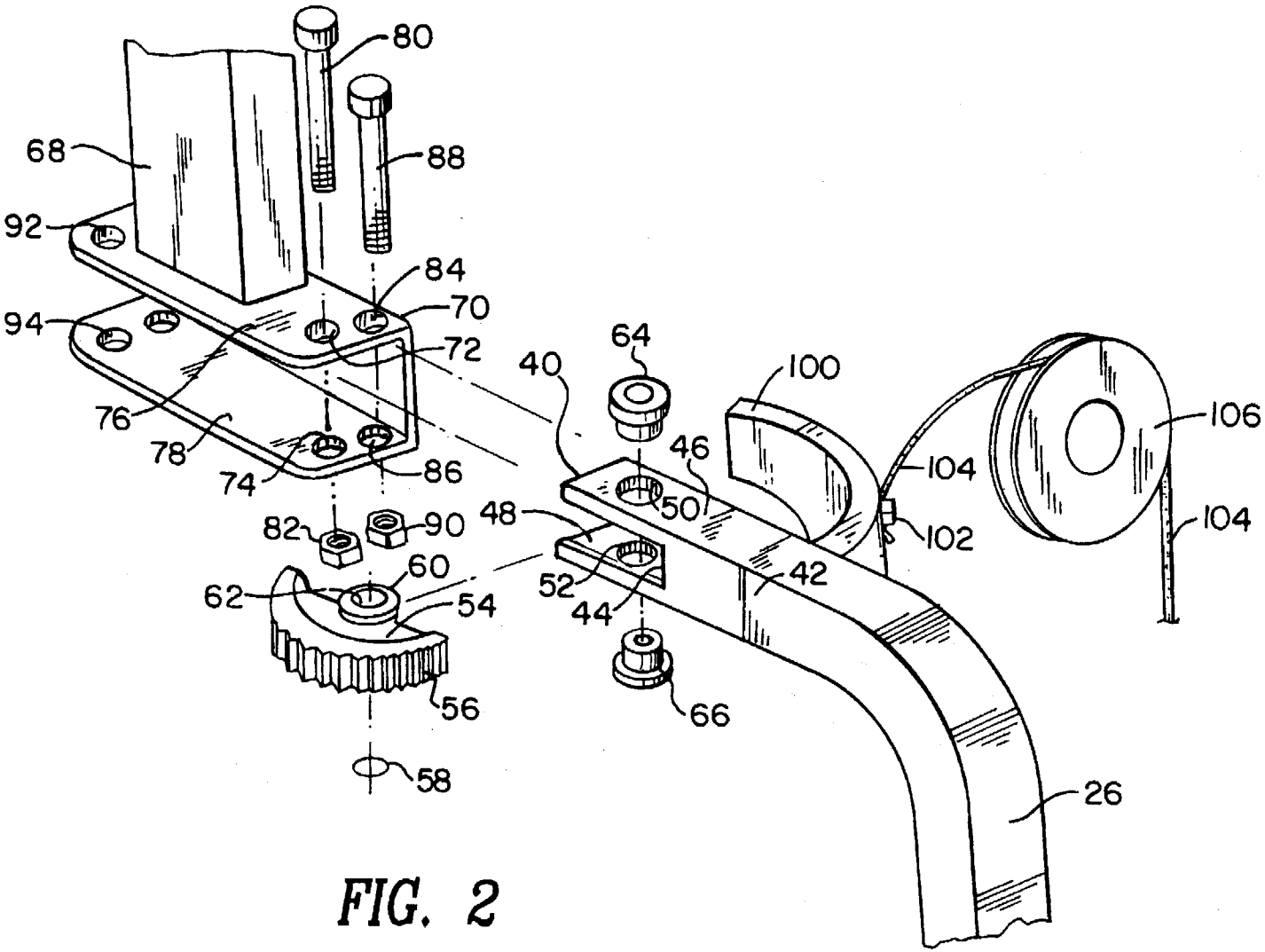
FIG. 2 is an enlarged exploded perspective view showing the mounting of one of the pair of exercise arms, the other exercise arm being mounted in an identical, but mirror-image, fashion.

The mounting of the exercise arm 26 will now be described, it being understood that the mounting of the exercise arm 24 is a mirror-image thereof. Thus, as shown in FIG. 2, at the end 40 of the exercise arm 26, which is the end opposite the hand grip end 30, the front side 42 of the arm 26 is cut away at 44 to expose the interior of the tubing making up the arm 26 both from the end 40 and the side 42. The top side 46 and the bottom side 48 of the arm 26 are provided with aligned openings 50, 52, respectively. A circular gear segment 54 is provided, having peripheral gear teeth 56 along a circular arc centered about a center of rotation, or axis, 58, and extending approximately 180° thereabout. The gear segment 54 has an enlarged central hub 60 having an opening 62 passing axially therethrough and centered about the axis 58. The gear segment 54 is secured to the exercise arm 26 by inserting it through the cut away portion 44 and aligning the opening 62 with the openings 50, 52. An upper bushing 64 having an enlarged head and a central axial opening is then inserted through the opening 50 of the exercise arm 26 and is press fit into the opening 62 of the gear segment 54. The enlarged head of the bushing 64 remains on the outside of the arm 26. Similarly, a lower bushing 66 having an enlarged head and a central axial opening is inserted through the lower opening 62 and is press fit into the opening 62 of the gear segment 54.

A pivot bar 68 is provided, having two ends and a longitudinal axis extending therebetween. A U-shaped bracket member 70 is secured to a first end of the pivot bar 68, as by welding or the like. The bracket member 70 extends laterally of the pivot bar 68 and is oriented with the open side of the U toward the front of the exercise apparatus 10. Aligned openings 72, 74 are provided in the upper and lower sides 76, 78, respectively, of the bracket member 70. The exercise arm 26 is mounted to the pivot bar 68 by inserting the end 40 into the space between the bracket member sides 76, 78, and then inserting the bolt 80 through the opening 72 of the bracket member 70, through the central axial opening of the upper bushing 64, through the opening 62 of the gear segment 54, through the central axial opening of the lower bushing 66 and through the opening 74 of the bracket member lower side 78. A nut 82 screwed onto the threaded end of the bolt 80 completes the assembly. The exercise arm 26 can thus pivot about the pivot axis 58, which is coaxial with the bolt 80. A second pair of aligned openings 84, 86 in the bracket sides 76, 78, respectively, and the bolt 88 extending therethrough and held in place by the nut 90, limits the rearward pivoting movement of the exercise arm 26. The exercise arm 24 is installed in a similar manner to the other side of the bracket member 70, with its pivot axis extending through the openings 92, 94 in the bracket sides 76, 78, respectively. The dimensions of all of the elements thus described are such that when the exercise arms 24, 26 are secured to the bracket member 70, the respective circular gear segments 54 are meshed, thereby interconnecting the exercise arms 24, 26 for concurrent pivoting movement in opposite angular directions about their respective pivot axes.

Figure 4:
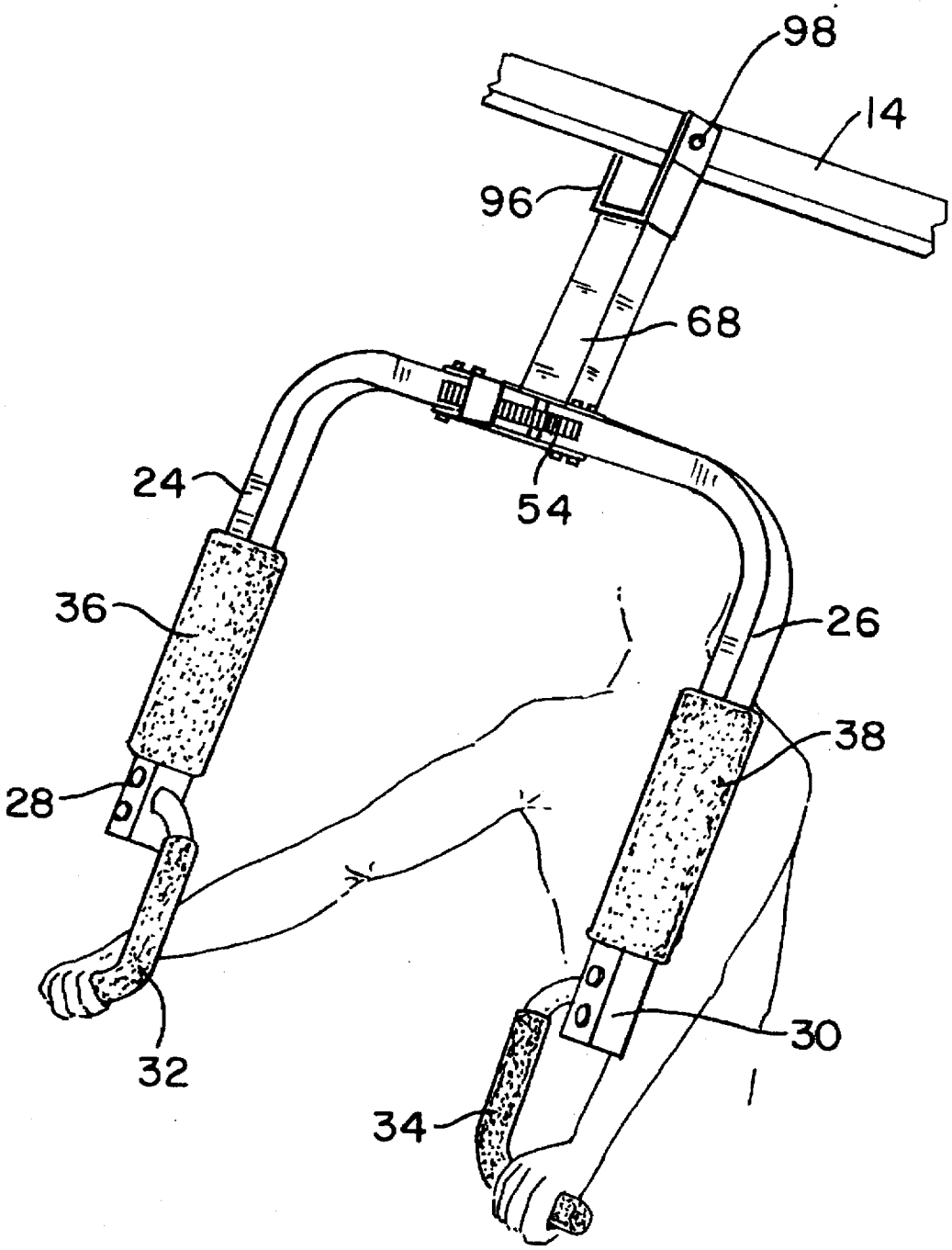
FIG. 4 is a partial perspective view of the apparatus of FIG. 1 showing its use for a bench press exercise.

As best shown in FIGS. 1 and 4, the other end of the pivot bar 68 has secured thereto a second U-shaped bracket member 96, as by welding or the like. The bracket member 96 has the open side of the U opposite the pivot bar 98 and is open toward the front and back of the exercise apparatus 10. The sides of the bracket member 96 flank the overhead member 14 and a bolt 98 extending through aligned openings (not shown) in the sides of the bracket member 96 and through aligned openings (not shown) in the overhead member 14 functions to secure the pivot bar 68 to the overhead member 14 for pivoting movement about a horizontal pivot axis orthogonal to the longitudinal axis of the pivot bar 68.

As best shown in FIG. 2, secured to the rear of the exercise arm 26, as by welding or the like, is a curved bar 100. When the exercise arm 26 is installed in the bracket member 70, the bar 100 is outside and behind the bracket member 70. A bolt 102 extends through an opening (not shown) in the bar 100 and is held in place by a nut (not shown). The bolt 102 is utilized for holding a first end of the cable 104. The second end of the cable 104 is secured to a corresponding curved bar (not shown) attached to the exercise arm 24. The cable 104 extends from the bolt 102, over the pulley 106, below the pulley 108, above the pulley 110 and to the exercise arm 24. As is clear from FIG. 1, movement of the exercise arms 24, 26 results in a lifting of the pulley 108, which causes a lifting of the pulley 112 which is associated with the cable 114. The cable 114 is anchored at 116 to the base 12 and is held at its end 118. Accordingly, lifting of the pulley 112 causes a lowering of the pulley 120 by a corresponding amount, which in turn causes a lowering of the pulley 122. The cable 124 is associated with the pulley 122 and is held at its end 126. The other end of the cable 124 is secured to the weight stack 16. Thus, forward movement of the exercise arms 24, 26 results in a lifting of that portion of the weight stack 16 which is above the pin 18 so as to provide resistance for exercising purposes, as is known in the art.

Figure 3:
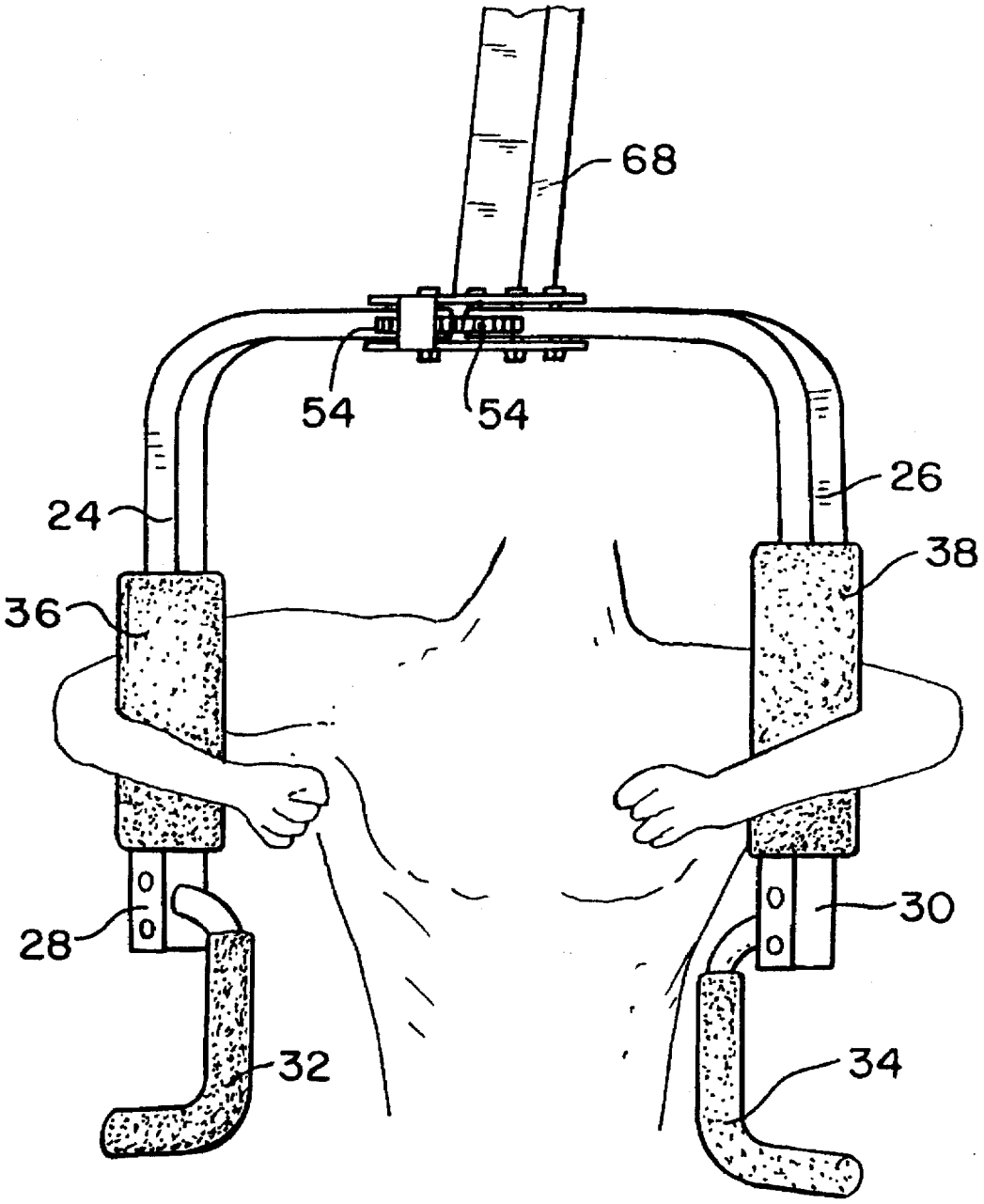
FIG. 3 is a partial perspective view of the apparatus of FIG. 1 showing its use for a butterfly exercise.

FIG. 3 illustrates the use of the exercise apparatus 10 for performing a butterfly exercise. Thus, the user sits on the seat 20 with his back supported by the back rest 22 and places his arms around the exercise arms 24, 26 with the cushions 36, 38 in the bends of his elbows. The butterfly exercise is performed by causing the exercise arms 24, 26 to pivot forwardly about the pair of parallel pivot axes 58 in the bracket member 70. Resistance is provided by the cabling arrangement to the weight stack 16, as described above. Since the exercise arms 24, 26 are interconnected by the circular gear segments 54, equal exercise is performed by both sides of the user's body. Further, both of the user's arms move at the same speed.

FIG. 4 illustrates the performing of a bench press exercise using the exercise apparatus 10. When performing a bench press exercise, the user sits on the seat 20 with his back supported by the back rest 22. He then grips the hand grips 32, 34 and pushes the exercise arms 24, 26 forward so that they pivot about the horizontal pivot axis defined by the bolt 98 through the overhead member 14. Resistance is provided by the cabling arrangement to the weight stack 16, as is the case with the butterfly exercise. The meshing of the circular gear segments 54 locks the exercise arms 24, 26 together for performing the bench press exercise without requiring any user modification for switching the exercise apparatus 10 between the two described types of exercises.

Accordingly, there has been disclosed exercise apparatus which enables the user to selectively perform a bench press exercise or a butterfly exercise using the same apparatus elements without requiring any modification to the apparatus by the user. While a preferred embodiment of the present invention has been disclosed herein, it is understood that various modifications and adaptations to the disclosed embodiment will be apparent to one of ordinary skill in the art and it is intended that this invention be limited only by the scope of the appended claims.

What is claimed is:

1. Exercise apparatus which enables a user to selectively perform a bench press exercise or a butterfly exercise, the apparatus comprising:

a support frame having a base and an overhead member;

a weight stack arranged for vertical reciprocatory movement relative to said base;

a pair of exercise arms each being generally L-shaped and each having a hand grip at one end;

a pivot bar having a first end, a second end and a longitudinal axis extending from said first end to said second end;

means for mounting said pair of exercise arms at their ends opposite their hand grip ends to said pivot bar first end for pivoting movement each about a respective one of a pair of parallel pivot axes, said mounting means being effective to orient said exercise arms each with the hand grip end below the opposite end and each in a respective plane substantially coplanar with the respective pivot axis;

means for interconnecting said pair of exercise arms for concurrent pivoting movement in opposite angular directions about said pair of pivot axes;

means for mounting said pivot bar at said pivot bar second end to said overhead member for pivoting movement about a horizontal pivot axis orthogonal to said pivot bar longitudinal axis; and means for coupling said pair of exercise arms to said weight stack to provide resistance to pivoting movement of said exercise arms each in a respective first angular direction about the respective one of said pair of pivot axes and to pivoting movement of said pivot bar in a respective first angular direction about said horizontal pivot axis.

2. The exercise apparatus according to claim 1 wherein said means for interconnecting includes a pair of intermeshed circular gear segments each secured to a respective exercise arm with its center of rotation aligned with a respective one of said pair of parallel pivot axes.

3. The exercise apparatus according to claim 1 wherein:

each of said exercise arms is formed of hollow rectangular tubing having a side cut away at its end opposite its hand grip end so as to expose the interior of said tubing from both said opposite end and said side; and said means for interconnecting includes:

pair of circular gear segments each having peripheral gear teeth along a circular arc centered about a respective center of rotation; and means for securing said pair of circular gear segments each in the interior of a respective exercise arm with its respective center of rotation aligned with a respective one of said pair of pivot axes, and with teeth extending out through the open opposite end and the open side of said respective exercise arm and intermeshed with teeth of the other of said circular gear segments.

4. The exercise apparatus according to claim 3 wherein said means for mounting said pair of exercise arms includes:

a U-shaped bracket member secured to said pivot bar first end, said bracket member extending laterally beyond said pair of pivot axes and oriented with the open side of the U toward said first angular directions of said exercise arms, said bracket member being sized to accept said opposite ends of said exercise arms between its opposed sides; and a pair of pivot pins each extending along a respective one of said pair of pivot axes and through apertures provided in said bracket member opposed sides, a respective one of said exercise arms and a respective one of said circular gear segments.

5. The exercise apparatus according to claim 4 further comprising:

means for preventing pivoting movement of said exercise arms each in a respective second angular direction beyond a predetermined angular orientation in which said pair of exercise arms are substantially coplanar.

6. The exercise apparatus according to claim 5 wherein said preventing means includes a pair of stop pins extending through apertures provided in said bracket member opposed sides, each of said stop pins being associated with a respective one of said exercise arms.

7. The exercise apparatus according to claim 1 further comprising:

means for preventing pivoting movement of said exercise arms each in a respective second angular direction beyond a predetermined angular orientation in which said pair of exercise arms are substantially coplanar.

* * * * *